US008314697B2

(12) United States Patent
Chen et al.

(10) Patent No.: US 8,314,697 B2
(45) Date of Patent: Nov. 20, 2012

(54) ELECTRIC SYSTEM AND ALARM DEVICE THEREOF

(75) Inventors: Chien-Hua Chen, Taoyuan Hsien (TW); Wei-Long Tai, Taoyuan Hsien (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 998 days.

(21) Appl. No.: 12/324,556

(22) Filed: Nov. 26, 2008

(65) Prior Publication Data

US 2009/0167528 A1 Jul. 2, 2009

(30) Foreign Application Priority Data

Dec. 26, 2007 (TW) ..... 96150223 A

(51) Int. Cl.
*G08B 21/00* (2006.01)

(52) U.S. Cl. ..... 340/540; 361/98; 361/58; 361/59; 361/75

(58) Field of Classification Search ..... 340/540; 361/98, 58, 59, 75, 77, 42; 323/277
See application file for complete search history.

(56) References Cited

U.S. PATENT DOCUMENTS 5,585,994 A * 12/1996 Tamai et al. ..... 361/98
5,727,928 A * 3/1998 Brown ..... 417/44.11
5,754,386 A * 5/1998 Barbour et al. ..... 361/154
6,182,742 B1 * 2/2001 Takahashi et al. ..... 165/104.33
6,686,836 B1 * 2/2004 Albert ..... 340/479
7,453,678 B2 * 11/2008 Beneditz et al. ..... 361/93.2
2002/0105765 A1 * 8/2002 Kondo et al. ..... 361/42
2004/0017204 A1 * 1/2004 Meert et al. ..... 324/511
2004/0212371 A1 * 10/2004 Nomoto et al. ..... 324/522
2005/0231870 A1 * 10/2005 Tajika ..... 361/71
2006/0126244 A1 * 6/2006 Kuo ..... 361/77
2007/0263332 A1 * 11/2007 Apfel ..... 361/90

* cited by examiner

*Primary Examiner* — Hoi Lau
(74) *Attorney, Agent, or Firm* — Muncy, Geissler, Olds & Lowe, PLLC

(57) ABSTRACT

An alarm device includes a first detecting unit and a controlling unit. The first detecting unit has an isolating circuit, a first enabling circuit, a second enabling circuit and an output circuit. The isolating circuit generates an adjusting signal according to an input signal. The first enabling circuit generates a first enabling signal according to the adjusting signal. The second enabling circuit generates a second enabling signal according to the first enabling signal. The output circuit outputs a first detecting signal according to the second enabling signal. The controlling unit outputs a control signal according to the first detecting signal. The control signal controls an electronic device to operate under a standby mode when the first detecting signal refers to an abnormal status.

16 Claims, 5 Drawing Sheets

ELECTRIC SYSTEM AND ALARM DEVICE THEREOF

CROSS REFERENCE TO RELATED APPLICATIONS

This Non-provisional application claims priority under 35 U.S.C. §119(a) on Patent Application No(s). 096150223, filed in Taiwan, Republic of China on Dec. 26, 2007, the entire contents of which are hereby incorporated by reference.

BACKGROUND OF THE INVENTION

1. Field of Invention

The present invention relates to an electronic system and an alarm device thereof.

2. Related Art

Functional requirements of an electronic apparatus are getting higher, and more accessory apparatuses are required by the electronic apparatus to satisfy the multi-functional requirement. Usually, a processor controls the electronic apparatus for the purpose of driving, controlling, detecting, indicating and communication transmitting.

Referring to FIG. 1, a conventional system 1 has a micro control unit (MCU) 12, a speed detecting end 13 and a fan 14. The micro control unit 12 is electrically connected to the electronic device, such as a fan, and the speed detecting end 13 for detecting the rotating speed of the fan 14.

According to an external input signal S01, the conventional micro control unit 12 can output a control signal S02 to control the fan 14. Herein, the external input signal S01 can be a pulse width modulation (PWM) signal, which is composed of at least one high-level digital signal and at least one low-level digital signal. The micro control unit 12 can control the fan 14 operating at a normal status, such as the fan operates at a certain rotating speed, according to the external input signal S01 (PWM signal).

If the micro control unit 12 has malfunction or damage in hardware due to the unknown external factors, it may continuously control the fan 14 operating at the high-speed or low-speed rotation status for a long time. This may cause the damage of the fan 14.

When the micro control unit 12 has malfunction or damage in hardware, it can not correctly control the operation of the fan 14 for dissipating heat. Therefore, the fan 14 can not perform the heat dissipation efficiently, and if this problem goes worse, the entire electronic apparatus may be shut down.

Moreover, the micro control unit 12 has a control interface (not shown), which is connected with a connector (not shown), so that the external input signal S01 can be inputted to the micro control unit 12 through the connector and the control interface. When the fan 14 operates normally, and the connector and the control interface are not perfectly connected or the connection therebetween is loosen due to vibration caused by the external force, the micro control unit 12 can not receive the external input signal S01. Thus, the fan 14 will keep operating. That is, the micro control unit 12 can not stop the operation of the fan 14 in this case, which may cause the extra power consumption and damage of the fan 14.

SUMMARY OF THE INVENTION

In view of the foregoing, the present invention is to provide an electronic system and an alarm device thereof capable of generating an alarm signal to warn the user that the micro control unit has malfunction or the micro control unit can not receive the external input signal S01. The present invention is also to provide an electronic system capable of definitely judging whether a peripheral device is in an abnormal status and immediately outputting an alarm, and an alarm device thereof.

To achieve the above, the present invention discloses an alarm device including a first detecting unit and a controlling unit. The first detecting unit receives an input signal and outputs a first detecting signal according to the input signal. The controlling unit is electrically connected to the first detecting unit for receiving the first detecting signal and outputting a control signal according to the first detecting signal. The control signal controls an electronic device to operate under a standby mode, which means to turn off the electronic device when the first detecting signal refers to an abnormal status. The abnormal status means the input signal or the second detecting signal is always a high level DC signal or a low level DC signal.

In addition, the present invention also discloses an electronic system including an alarm device and a system device. The alarm device receives an input signal and generates a control signal according to the input signal. The system device is electrically connected to the alarm device for receiving the control signal, generating a system signal according to the control signal and outputting the system signal to the alarm device.

As mentioned above, the electronic system and the alarm device thereof according to the present invention both have the first detecting unit and the second detecting unit for respectively generating the first and second detecting signals. The controlling unit and the system device respectively receive the first detecting signal and the second detecting signal and judge whether the input signal refers to the abnormal status according to the first and second detecting signals. When the input signal refers to the abnormal status, the alarm device generates the control signal to immediately stop the operation of the electronic device and thus prevent the damage or the crash when the processor continues operating in the abnormal status due to the misjudgment. Thus, the overall quality can be enhanced.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
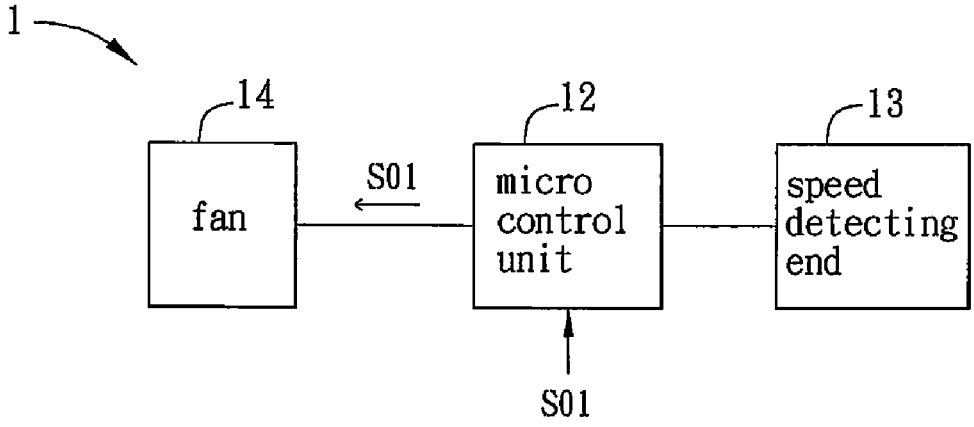
FIG. 1(Prior Art)
FIG. 1 is a schematic illustration showing a conventional system.
Figure 2:
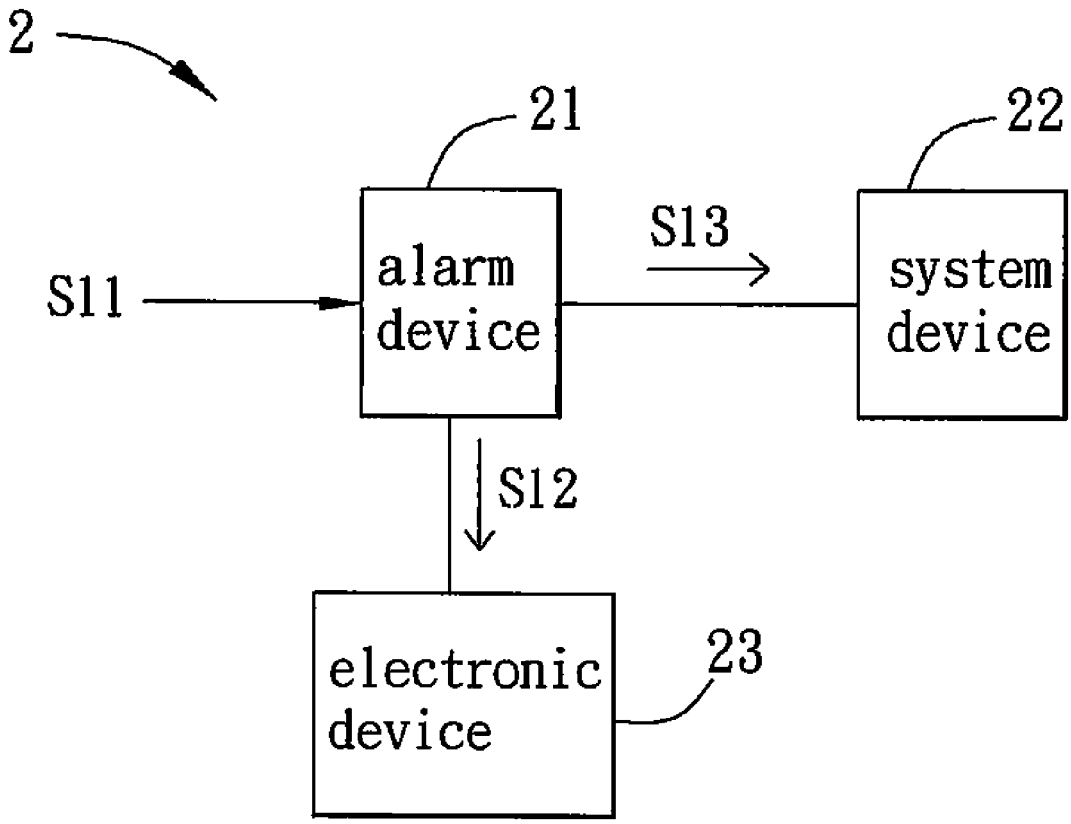
FIG. 2 is a schematic illustration showing an electronic system according to a preferred embodiment of the present invention.

Referring to FIG. 2, an electronic system 2 according a first embodiment of the present invention includes an alarm device 21, a system device 22 and an electronic device 23. The alarm device 21 is electrically connected to the electronic device 23 and receives an input signal S11, which can be a DC signal or a pulse signal. When the input signal S11 is a pulse signal, it can be a pulse width modulation (PWM) signal with the frequency equal to or higher than 200 Hz.

In addition, the input signal S11 can be a feedback signal of the electronic device 23. The input signal S11 is determined to be a pulse signal or a DC signal according to the status of the electronic device 23. When the electronic device 23 operates in a normal status, the input signal S11 is the pulse signal. When the electronic device 23 operates in a floating, a short or an open status, the input signal S11 is the DC signal, for example. In this embodiment, the input signal S11 is an external input signal, for example.

The alarm device 21 generates a control signal S12 and a second detecting signal S13 according to the input signal S11, and the control signal S12 controls the electronic device 23. The electronic device 23 can be a fan device, a sensor device, a power supply device, a communication device, a flat panel display, an indicating device or a pressure indicating device.

The system device 22 electrically connected to the alarm device 21 receives the second detecting signal S13 and thus judges whether the input signal S11 refers to an abnormal status according to the second detecting signal S13. In this embodiment, the system device 22 is disposed at a client end.

Figure 3:
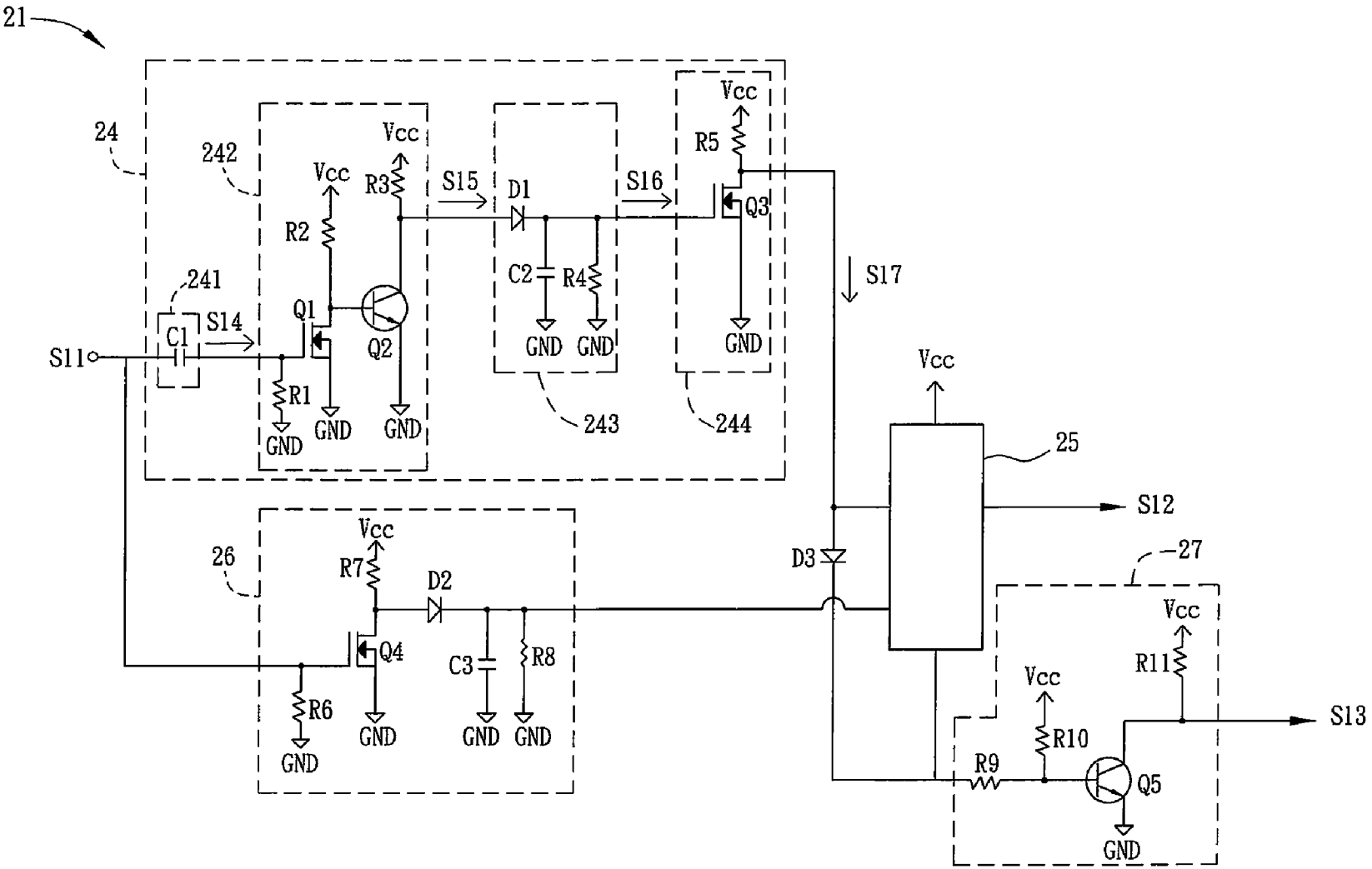
FIG. 3 is a schematic illustration showing an alarm device of the electronic system according to the preferred embodiment of the present invention.

FIG. 3 shows an equivalent circuit diagram of the alarm device 21 of FIG. 2. Referring to FIGS. 2 and 3, the alarm device 21 includes a first detecting unit 24 and a controlling unit 25. The controlling unit 25 is electrically connected to the first detecting unit 24. The controlling unit 25 is a microprocessing unit.

The first detecting unit 24 has an isolating circuit 241, a first enabling circuit 242, a second enabling circuit 243 and an output circuit 244. In this embodiment, the isolating circuit 241 has a capacitor C1. The capacitor C1 has one terminal for receiving the input signal S11, and the other terminal electrically connected to the first enabling circuit 242. The isolating circuit 241 generates an adjusting signal S14 according to the input signal S11 and transmits the adjusting signal S14 to the first enabling circuit 242. The first enabling circuit 242 receives the adjusting signal S14 and thus generates a first enabling signal S15 according to the adjusting signal S14.

As shown in FIG. 3, the first enabling circuit 242 has a resistor R1, a resistor R2, a resistor R3, a transistor Q1 and a transistor Q2. The transistor Q1 has a gate electrically connected to the isolating circuit 241 and the resistor R1 to receive the adjusting signal S14, and a source electrically connected to a ground GND. The resistor R2 has one terminal for receiving a power supply voltage $V_{CC}$. The transistor Q2 has a base electrically connected to the other terminal of the resistor R2 and a drain of the transistor Q1, and an emitter electrically connected to the ground GND. The resistor R3 has one terminal for receiving the power supply voltage $V_{CC}$. A collector of the transistor Q2 is electrically connected to the other terminal of the resistor R3, and outputs the first enabling signal S15 to the second enabling circuit 243. The transistor Q1 and the transistor Q2 are a metal-oxide-semiconductor field-effect transistor (MOSFET) and a bipolar junction transistor (BJT), respectively.

The second enabling circuit 243 electrically connected to the first enabling circuit 242 receives the first enabling signal S15 and thus generates a second enabling signal S16 according to the first enabling signal S15. The second enabling circuit 243 has a resistor R4, a diode D1 and a capacitor C2.

The diode D1 has one terminal electrically connected to the output circuit 244, and the other terminal electrically connected to the resistor R3 and the first enabling circuit 242 to receive the first enabling signal S15. The capacitor C2 has one terminal electrically connected to one terminal of the diode D1 and one terminal of the resistor R4 to generate the second enabling signal S16 and to output the second enabling signal S16 to the output circuit 244. The other terminal of the capacitor C2 and the other terminal of the resistor R4 are electrically connected to the ground GND.

The second enabling circuit 243 can be an R-C adjustable integrator, and the diode D1 is used for preventing the current of the second enabling circuit 243 from flowing back to the resistor R3.

As shown in FIG. 3, the output circuit 244 receives the second enabling signal S16 and thus generates a first detecting signal S17 according to the second enabling signal S16. The output circuit 244 has a resistor R5 and a transistor Q3. The transistor Q3 has a gate electrically connected to the second enabling circuit 243 to receive the second enabling signal S16, and a source electrically connected to the ground GND. The resistor R5 has one terminal for receiving the power supply voltage $V_{CC}$. A drain of the transistor Q3 is electrically connected to the other terminal of the resistor R5 and the controlling unit, and generates the first detecting signal S17. The transistor Q3 can be a MOSFET.

The operations of the first detecting unit 24 will be described in detail in the following with reference to FIGS. 2 and 3. The isolating circuit 241 receives the input signal S11 by the capacitor C1 and generates the adjusting signal S14 according to the input signal S11. Herein, the input signal S11 is a pulse signal.

When the input signal S11 is high, the gate of the transistor Q1 in the first enabling circuit 242 receives the adjusting signal S14 so that the transistor Q1 turns on according to the adjusting signal S14 and outputs the low-level signal from the drain of the transistor Q1 to the transistor Q2 to make the transistor Q2 turn off.

At this time, the power supply voltage $V_{CC}$, the resistor R3, the diode D1, the capacitor C2 and the resistor R4 form a current loop, and the power supply voltage $V_{CC}$ turns on the diode D1 to charge the resistor (R4)-capacitor (C2) circuit so that the second enabling circuit 243 outputs the high-level second enabling signal S16 to the output circuit 244.

The transistor Q3 turns on according to the second enabling signal S16 and outputs the low-level first detecting signal S17 from the drain of the transistor Q3 to the controlling unit 25.

As mentioned hereinabove, when the input signal S11 is in low level, the output circuit 244 outputs the high-level first detecting signal S17. Thus, the controlling unit 25 receives the first detecting signal S17 and obtains that the input signal S11 refers to the normal status according to the first detecting signal S17, that is, if the input signal S11 is a pulse signal, the first detecting signal S17 is also a pulse signal, and the alarm device 21 keeps generating the control signal S12 to control the electronic device 23 to keep the electronic device 23 operating.

As shown in FIGS. 2 and 3, when the input signal S11 refers to the abnormal status (The abnormal status means the input signal is always a high level DC signal or a low level DC signal), the operations of the first detecting unit 24 are described in the following.

When the input signal S11 refers to the abnormal status, the input signal S11 is a DC signal and is transmitted to the isolating circuit 241. At this time, the isolating circuit 241 isolates the input signal S11 via the capacitor C1, and thus generates the low-level adjusting signal S14. The first transistor Q1 of the first enabling circuit 242 turns off according to the low-level adjusting signal S14, and the transistor Q2 receives the power supply voltage $V_{CC}$ via the resistor R2 and thus turns on. Next, the power supply voltage $V_{CC}$ connected to the resistor R3 is grounded via the transistor Q2, and the drain of the transistor Q2 outputs the low-level first enabling signal S15.

Because the drain of the transistor Q2 is in the low level, the diode D1 turns off and the capacitor C2 starts to discharge the energy to the resistor R4. After a period of time, the stored charges of the capacitor C2 are decreased so that the second enabling circuit 243 outputs the low-level second enabling signal S16 to the output circuit 244. However, the low-level second enabling signal S16 cannot make the transistor Q3 turn on, and the first detecting signal S17 is obtained by subtracting the voltage drop of the resistor R5 from the power supply voltage $V_{CC}$. Thus, the output circuit 244 outputs the high-level first detecting signal S17.

As shown in FIG. 3, the alarm device 21 of this embodiment further includes a signal converting unit 26, which includes a resistor R6, a resistor R7, a resistor R8, a transistor Q4, a capacitor C3 and a diode D2.

The transistor Q4 has a gate electrically connected to the resistor R6 to receive the input signal S11, and a source electrically connected to the ground. The resistor R7 has one terminal for receiving the power supply voltage $V_{CC}$. A drain of the transistor Q4 is electrically connected to the other terminal of the resistor R7 and one terminal of the diode D2. The other terminal of the diode D2 is electrically connected to one terminal of the capacitor C3 and one terminal of the resistor R8. The other terminal of the capacitor C3 and the other terminal of the resistor R8 are electrically connected to the ground GND.

When the input signal S11 is in low level, the gate of the transistor Q4 receives the input signal S11 and makes the transistor Q4 turn off according to the input signal S11. At this time, the power supply voltage $V_{CC}$, the resistor R7, the diode D2, the capacitor C3 and the resistor R8 form a current loop, and the power supply voltage $V_{CC}$ makes the diode D2 turn on and thus charges the capacitor C3.

When the input signal is in high level, the gate of the transistor Q4 receives the input signal S11 and makes the transistor Q4 turn on according to the input signal S11 so that the low level signal is outputted from the drain of the transistor Q4. At this time, the capacitor C3 discharges the energy to the resistor R8 and thus provides the DC signal to the controlling unit 25.

When the electronic device is in a normal status, the signal converting unit 26 is used to convert the input signal, which is also a PWM signal to a DC signal and output the DC signal to the controlling unit 25.

Referring to FIG. 3, the alarm device 21 of this embodiment further includes a second detecting unit 27, which includes a resistor R9, a resistor R10, a resistor R11 and a transistor Q5. The transistor Q5 may be a BJT. A diode D3 is provided to prevent the current of the second detecting unit 27 from flowing back to the first detecting unit 24.

Figure 4:
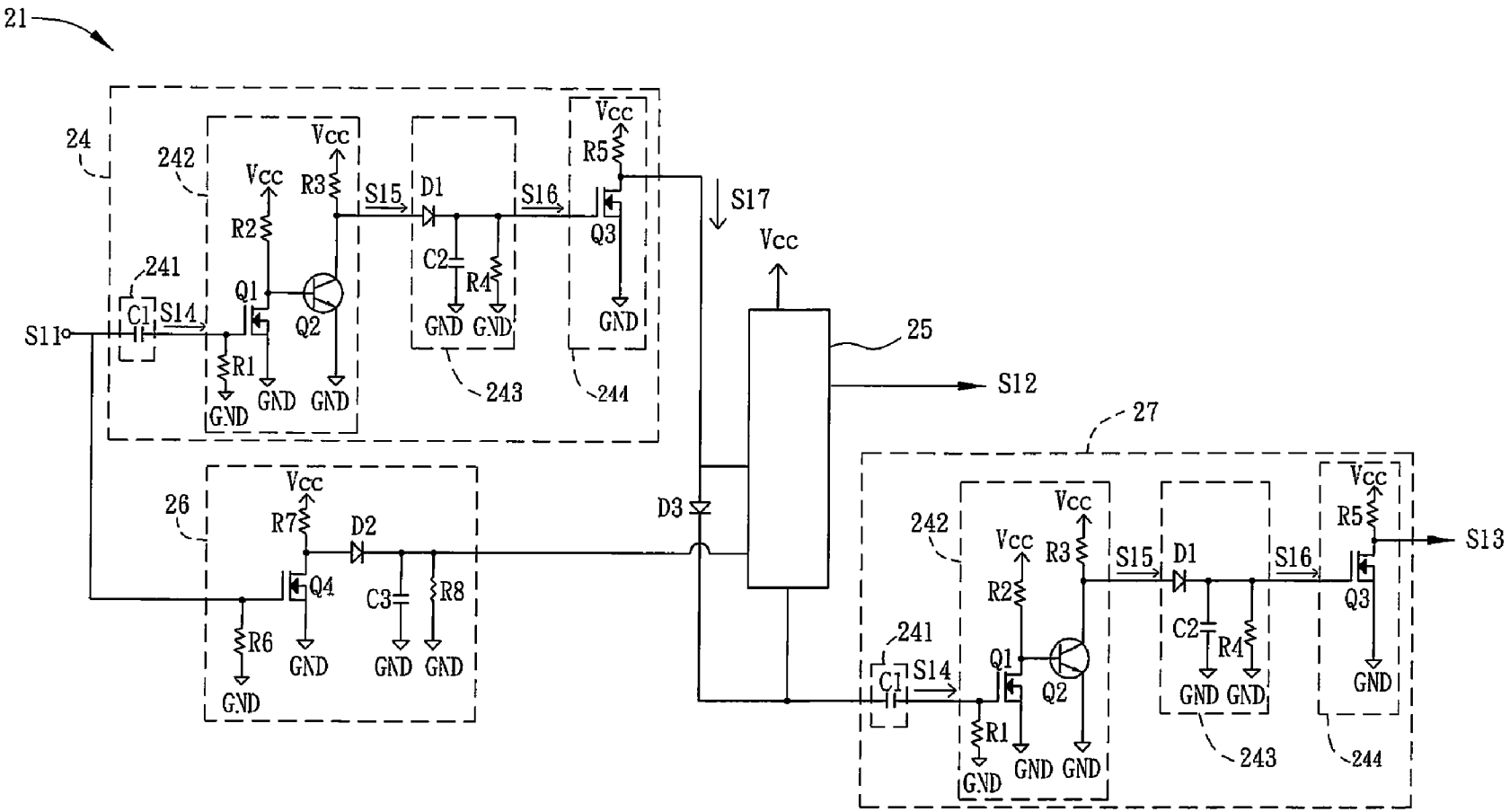
FIG. 4 is a schematic illustration showing a second detecting unit of the electronic system according to the preferred embodiment of the present invention.

In addition, the aspect of the second detecting unit 27 is not particularly restricted in this embodiment. As shown in FIG. 4, the second detecting unit 27 and the first detecting unit 24 can have the same elements. In the following, the second detecting unit 27 of FIG. 3 will be described as an example.

The resistor R9 has one terminal electrically connected to the first detecting unit 24 to receive the first detecting signal S17, and the other terminal electrically connected to a base of the transistor Q5. The resistor R10 has one terminal for receiving the power supply voltage $V_{CC}$, and the other terminal electrically connected to the other terminal of the resistor R9 and the base of the transistor Q5. The transistor Q5 also has an emitter electrically connected to the ground GND, and a collector electrically connected to one terminal of the resistor R11 to generate the second detecting signal S13.

When the first detecting signal S17 is high, the base of the transistor Q5 receives the first detecting signal S17 and makes the transistor Q5 turn on according to the first detecting input signal S17 so that the collector of the transistor Q5 outputs the low-level second detecting signal S13. When the first detecting signal S17 is low, the base of the transistor Q5 receives the first detecting signal S17 and makes the transistor Q5 turn off according to the first detecting signal S17. The second detecting signal S13 is obtained by subtracting the voltage drop of the resistor R11 from the power supply voltage $V_{CC}$. Therefore, the second detecting unit 27 outputs the high-level second detecting signal S13. In other words, if the input signal S11 is a pulse or PWM signal, the second detecting signal S13 is also a pulse or PWM signal.

As mentioned hereinabove, when the input signal S11 is the pulse signal, the second detecting signal S13 is also the pulse signal in the normal status. When the second detecting signal S13 is continuously kept at the high level or the low level for a period of time, it represents that the input signal S11 refers to the abnormal status.

As shown in FIGS. 2 and 3, when the controlling unit 25 receives the first detecting signal S17, which refers to the abnormal status, or the system device 22 receives the second detecting signal S13, which refers to the abnormal status, the alarm device 21 generates the control signal S12 to make the electronic device 23 operate under a standby mode, such as a sleep mode or an idle mode. Herein, the electronic device 23 is a fan device in the following example. When the fan device is in the standby mode, the power supply voltage of the fan device is cut off to stop the fan device and prevent the fan device from continuously operating to cause the damage or to crash the electronic system 2.

Figure 5:
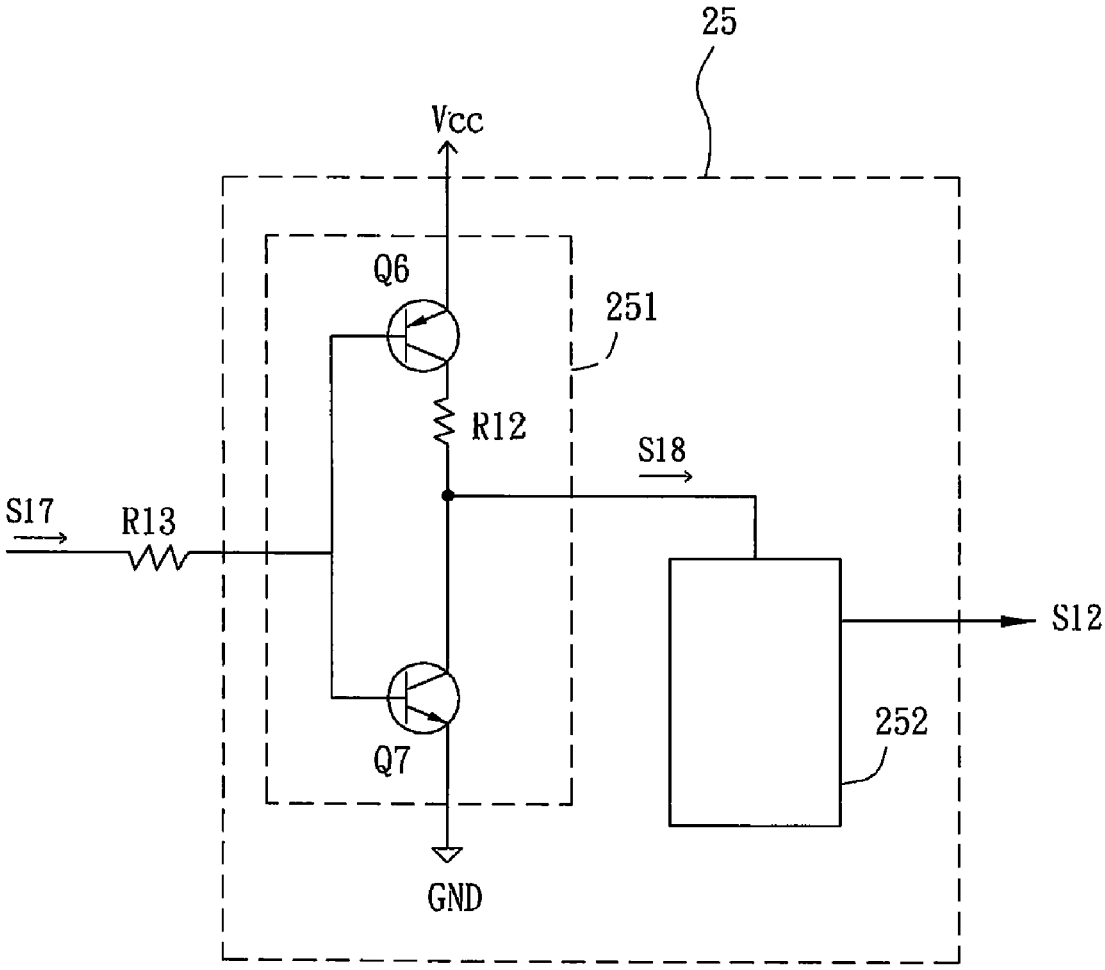
FIG. 5 is a schematic illustration showing a controlling unit of the electronic system according to the preferred embodiment of the present invention.

Referring to FIG. 5, the controlling unit 25 includes an inverting circuit 251 and a driving circuit 252 electrically connected to the inverting circuit 251.

The inverting circuit 251 electrically connected to the first detecting unit 24 receives the first detecting signal S17 and outputs a first inverse detecting signal S18 according to the first detecting signal S17. The inverting circuit includes a transistor Q6, a transistor Q7 and a resistor R12.

The transistor Q6 has a base electrically connected to a resistor R13 and a base of the transistor Q7, and an emitter for receiving the power supply voltage $V_{CC}$. The transistor Q7 has an emitter electrically connected to the ground. The resistor R12 has one terminal electrically connected to a collector of the transistor Q6, and the other terminal electrically connected to a collector of the transistor Q7.

The first detecting signal S17 is inputted to the controlling unit 25 via the resistor R13. When the first detecting signal S17 is in high level, the transistor Q6 turns off and the transistor Q7 turns on. At this time, the inverting circuit 251 outputs and transmits the low-level first inverse detecting signal S18 to the driving circuit 252.

When the first detecting signal S17 is in low level, the transistor Q7 turns off and the transistor Q6 turns on. At this time, the inverting circuit 251 outputs and transmits the high-level first inverse detecting signal S18 to the driving circuit 252. The driving circuit 252 receives the first inverse detecting signal S18 and outputs the control signal S12 according to the first inverse detecting signal S18.

In summary, the electronic system and the alarm device thereof according to the present invention both have the first detecting unit and the second detecting unit for respectively generating the first and second detecting signals. The controlling unit and the system device respectively receive the first detecting signal and the second detecting signal, and judge whether the input signal refers to the abnormal status according to the first and second detecting signals. When the input signal refers to the abnormal status, the alarm device generates the control signal to immediately stop the operation of the electronic device and thus prevent the damage or the crash when the processor continues operating in the abnormal status due to the misjudgment. Thus, the overall quality can be enhanced.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An alarm device, comprising:

a first detecting unit for receiving an input signal and outputting a first detecting signal according to the input signal; and a controlling unit electrically connected to the first detecting unit for receiving the first detecting signal and outputting a control signal according to the first detecting signal, wherein the control signal controls an electronic device to operate under a standby mode when the first detecting signal refers to an abnormal status;

wherein the first detecting unit comprises:

an isolating circuit for receiving the input signal and generating an adjusting signal according to the input signal;

a first enabling circuit electrically connected to the isolating circuit for receiving the adjusting signal and generating a first enabling signal according to the adjusting signal;

a second enabling circuit electrically connected to the first enabling circuit for receiving the first enabling signal and generating a second enabling signal according to the first enabling signal; and an output circuit electrically connected to the second enabling circuit for receiving the second enabling signal and outputting the first detecting signal according to the second enabling signal; and wherein the first enabling circuit comprises:

a first resistor having a first terminal for receiving a power supply voltage;

a first transistor having a gate electrically connected to the isolating circuit to receive the adjusting signal, a drain electrically connected to a second terminal of the first resistor, and a source electrically connected to a ground;

a second resistor having a first terminal electrically connected to the gate of the first transistor, and a second terminal electrically connected to the ground;

a third resistor having a first terminal for receiving the power supply voltage; and a second transistor having a base electrically connected to the second terminal of the first resistor and the drain of the first transistor, an emitter electrically connected to the ground, and a collector electrically connected to a second terminal of the third resistor for outputting the first enabling signal.

2. The alarm device according to claim 1, wherein the isolating circuit has a capacitor having a first terminal receiving the input signal and a second terminal electrically connected to the first enabling circuit.

3. The alarm device according to claim 1, wherein the first transistor is a metal-oxide-semiconductor field-effect transistor (MOSFET) and the second transistor is a bipolar junction transistor (BJT).

4. The alarm device according to claim 1, wherein the second enabling circuit is an R-C adjustable integrator and the second enabling circuit comprises:

a diode comprising a first terminal electrically connected to the first enabling circuit to receive the first enabling signal;

a fourth resistor comprising a first terminal electrically connected to a ground; and a capacitor comprising a first terminal electrically connected to a second terminal of the diode and a second terminal of the fourth resistor to generate the second enabling signal, and a second terminal electrically connected to the ground.

5. The alarm device according to claim 1, wherein the output circuit comprises:

a fifth resistor having a first terminal for receiving a power supply voltage; and a third transistor having a gate electrically connected to the second enabling circuit to receive the second enabling signal, a drain electrically connected to a second terminal of the fifth resistor to output the first detecting signal, and a source electrically connected to a ground.

6. The alarm device according to claim 1, wherein the input signal is a pulse signal or a DC signal, and the input signal is a DC signal when the first detecting signal refers to an abnormal status.

7. The alarm device according to claim 6, wherein the pulse signal is a pulse width modulation (PWM) signal, and a frequency of the pulse signal is equal to or higher than 200 Hz.

8. The alarm device according to claim 1, wherein the standby mode is a sleep mode or an idle mode, and the electronic device is turned off when the electronic device operates under the standby mode.

9. The alarm device according to claim 1, further comprising:

a second detecting unit electrically connected to the first detecting unit and the controlling unit for outputting a second detecting signal according to the first detecting signal and/or the control signal.

10. The alarm device according to claim 9, further comprising:

a diode having a first terminal electrically connected to the first detecting unit, and a second terminal electrically connected to the second detecting unit.

11. The alarm device according to claim 9, wherein the second detecting unit comprises:

a first resistor having a first terminal electrically connected to the first detecting unit and the controlling unit;

a transistor having a base electrically connected to a second terminal of the first resistor, an emitter electrically connected to a ground, and a collector for outputting the second detecting signal;

a second resistor having a first terminal for receiving a power supply voltage and a second terminal electrically connected to the base of the transistor; and a third resistor having a first terminal for receiving the power supply voltage and a second terminal electrically connected to the collector of the transistor.

12. The alarm device according to claim 1, further comprising:

a signal converting unit electrically connected to the controlling unit for receiving the input signal which is a pulse signal and converting the input signal into a voltage signal.

13. The alarm device according to claim 12, wherein the signal converting unit comprises:

a transistor having a gate for receiving the input signal and a source electrically connected to a ground;

a first resistor having a first terminal electrically connected to the gate of the transistor, and a second terminal electrically connected to the ground;

a second resistor having a first terminal for receiving a power supply voltage, and a second terminal electrically connected to a drain of the transistor;

a diode having a first terminal electrically connected to the drain of the transistor, and a second terminal electrically connected to the controlling unit;

a capacitor having a first terminal electrically connected to the second terminal of the diode and the controlling unit to output the voltage signal, and a second terminal electrically connected to the ground; and a third resistor having a first terminal electrically connected to the second terminal of the diode, and a second terminal electrically connected to the ground.

14. The alarm device according to claim 1, wherein the controlling unit is a micro-processing unit, and the alarm device further comprises a resistor having a first terminal electrically connected to the first detecting unit, and a second terminal electrically connected to the controlling unit.

15. The alarm device according to claim 1, wherein the controlling unit comprises:

an inverting circuit electrically connected to the first detecting unit for receiving the first detecting signal and outputting a first inverse detecting signal according to the first detecting signal; and a driving circuit electrically connected to the inverting circuit for receiving the first inverse detecting signal and outputting the control signal according to the first inverse detecting signal.

16. The alarm device according to claim 15, wherein the inverting circuit comprises:

a first transistor having a base electrically connected to the first detecting unit, and an emitter for receiving a power supply voltage;

a second transistor having a base electrically connected to the first detecting unit and the base of the first transistor, and an emitter electrically connected to a ground; and a resistor having a first terminal electrically connected to a collector of the first transistor, and a second terminal electrically connected to a collector of the second transistor.

* * * * *